US006499947B2

(12) United States Patent
Olthof

(10) Patent No.: US 6,499,947 B2
(45) Date of Patent: Dec. 31, 2002

(54) HOUSING PART FOR A VENTILATING FAN

(75) Inventor: Henricus Johannes Bernhardus Olthof, Nijverdal (NL)

(73) Assignee: Ventilatoren Sirocco Howden B.V., Hengelo (NL)

( * ) Notice: Subject to any disclaimer, the term of this patent is extended or adjusted under 35 U.S.C. 154(b) by 0 days.

(21) Appl. No.: 09/754,825

(22) Filed: Jan. 4, 2001

(65) Prior Publication Data

US 2001/0021345 A1 Sep. 13, 2001

(30) Foreign Application Priority Data

Jan. 5, 2000 (NL) ..... 1014013

(51) Int. Cl.[7] ..... F03B 11/02
(52) U.S. Cl. ..... 415/214.1; 415/220
(58) Field of Search ..... 415/181, 119, 415/200, 213.1, 214.1, 220

(56) References Cited

U.S. PATENT DOCUMENTS 2,466,827 A * 4/1949 Roth ..... 139/39
4,508,486 A * 4/1985 Tinker ..... 415/119
4,548,548 A * 10/1985 Gray, III ..... 416/189
5,348,446 A * 9/1994 Lee et al. ..... 416/241 R

FOREIGN PATENT DOCUMENTS

JP 61215019 A * 9/1986 ..... B29C/41/04

* cited by examiner

*Primary Examiner*—Edward K. Look
*Assistant Examiner*—Dwayne J. White
(74) *Attorney, Agent, or Firm*—Webb Ziesenheim Logsdon Orkin & Hanson, P.C.

(57) ABSTRACT

Disclosed is a housing part for a ventilating fan with an axial rotation shaft. A number of housing parts can be placed radially around the ventilating fan so as to form a substantially cylindrical housing. The housing part includes an inner wall; an outer wall placed at a distance from the inner wall; and connecting walls extending between the inner wall and the outer wall. The inner wall, outer wall and the connecting walls define a closed space.

14 Claims, 2 Drawing Sheets

HOUSING PART FOR A VENTILATING FAN

BACKGROUND OF THE INVENTION

The invention relates to a housing part for a ventilating fan with an axial rotation shaft, wherein a number of housing parts can be placed radially round the ventilating fan so as to form a substantially cylindrical housing.

The above stated housing parts are applied in for instance cooling devices, for instance for incinerator plants. Such a cooling device consists of a frame on which a large number of heat exchangers are placed. Placed under these heat exchangers is a fan which has a diameter of for instance 10 m. Housing parts are placed round this ventilating fan in order to enable large amounts of air to be drawn in and blown through the heat exchangers located thereabove.

It is known that the housing for the ventilating fan is constructed from four or eight housing parts. These housing parts can be manufactured from wood, concrete, steel or polyester. Since a limited number of housing parts is used to assemble a housing, the housing parts are specifically manufactured for a specific fan diameter. The wall parts all take a single-walled form, The above stated known housing parts have a number of drawbacks. First of all, the wall parts are easily set into vibration, which can result in mechanical damage because they are single-walled. This also causes additional noise which, in view of current standards, is undesirable. The wall thickness would have to be increased to prevent this, but with the usual materials this can result in very large masses of the wall parts, whereby the construction to which these wall parts have to be fixed must take an extra-strong form.

Between four and eight housing parts have normally been used heretofore to assemble the housing. As a consequence of the large fan diameters, the dimensions of the housing parts are correspondingly large. This therefore has its drawbacks for transport and handling during fitting.

SUMMARY OF THE INVENTION

It is an object of the invention to obviate the above stated drawbacks.

This is achieved according to the invention with a housing part which comprises:

an inner wall;

an outer wall placed at a distance from the inner wall; and connecting walls extending between the inner wall and the outer wall;

wherein the inner wall, the outer wall and the connecting walls define a closed space.

The housing part thus takes a double-walled form. The housing part hereby has a relatively great strength compared to a single-walled housing part, while the weight is relatively low. Because the housing part takes a double-walled form the housing part will cause fewer vibrations and therefore less noise. In addition, the weight is relatively low, thus simplifying assembly.

A preferred embodiment according to the invention comprises at least one strengthening bush which is arranged with the one end on the inner wall and with the other end on the outer wall. The inner wall and the outer wall are mutually connected by the strengthening bushes, whereby the housing part is given additional strength.

The at least one strengthening bush is preferably arranged such that in the formed housing the strengthening bush lies substantially in the same plane as the outer ends of the ventilating fan.

Air turbulences will occur around the extremities of the ventilating fan whereby a housing part could begin to vibrate and thus also cause noise. By now arranging the strengthening bushes such that they lie at the same height as the outer ends of the ventilating fan the housing part will be strengthened locally, whereby vibrations resulting from the air turbulences are prevented.

In another pref erred embodiment according to the invention coupling means are arranged on either side for coupling to an adjoining housing part.

A housing for a ventilating fan is constructed by placing the housing parts against each other around the fan. It is advantageous herein to be able to couple the adjoining housing parts relative to each other, so that they cannot shift relative to each other.

The coupling means preferably comprise a groove arranged on a first side of the housing part and a rib which is arranged on a second side of the housing part and which can be coupled with the groove of an adjoining housing part. By now sliding the rib of one housing part into the groove of an adjoining housing part these housing parts are coupled relative to each other.

In yet another embodiment according to the invention metal parts are arranged in at least one of the walls. These parts can for instance be used to secure bolts or screws therein with which the whole housing part can be fixed or, for instance, two housing parts can be fixed to each other.

In a preferred embodiment according to the invention the closed space is filled with a foamed material. An additional strengthening of the housing part is hereby obtained and the foam, owing to its structure, contributes toward extra noise reduction.

A housing part according to the invention is preferably manufactured by rotation moulding. Preferred materials here are polyethylene or polypropylene.

In yet another embodiment according to the invention the inner wall and the outer wall comprise a first curvature around a first axis of curvature. The inner surface of an assembled housing will hereby better approximate a cylinder surface, thereby reducing vibrations.

In a further preferred embodiment according to the invention the inner wall and the outer wall comprise a second curvature around a second axis of curvature, wherein the second axis of curvature lies perpendicularly of the first axis of curvature. The housing formed with such housing parts therefore has an outward protruding edge, whereby the supply of air is better guided.

The width of a housing part is preferably less than 2 m. The housing parts can hereby be readily placed in a transport container, whereby the housing parts can be transported easily over large distances.

The invention further comprises a housing for a ventilating fan with an axial rotation shaft, which housing comprises:

a first number of housing parts according to the invention placed against each other radially around the ventilating fan; and fixing means for holding the housing parts fixed against each other.

The fixing means can be for instance bolts and nuts extending through edges of two adjoining housing parts. Preferably however, the fixing means comprise a tensioning belt extending around the housing. A cylinder shape results automatically from placing of the housing parts against each other and then clamping them with a tensioning belt.

In another embodiment according to the invention the housing comprises a second number of housing parts placed against each other and in the line of the first number of housing parts according to the invention.

When air is drawn by the ventilating fan through a housing and then blown for instance through heat exchangers, the air must be blown back again into the environment. By now placing a second number of housing parts in the line of the first number the air is guided into the environment, whereby further noise reduction is obtained.

BRIEF DESCRIPTION OF THE DRAWINGS

These and other features of the invention are further elucidated with reference to the annexed drawings.

DETAILED DESCRIPTION OF THE PREFERRED EMBODIMENTS

Figure 1:
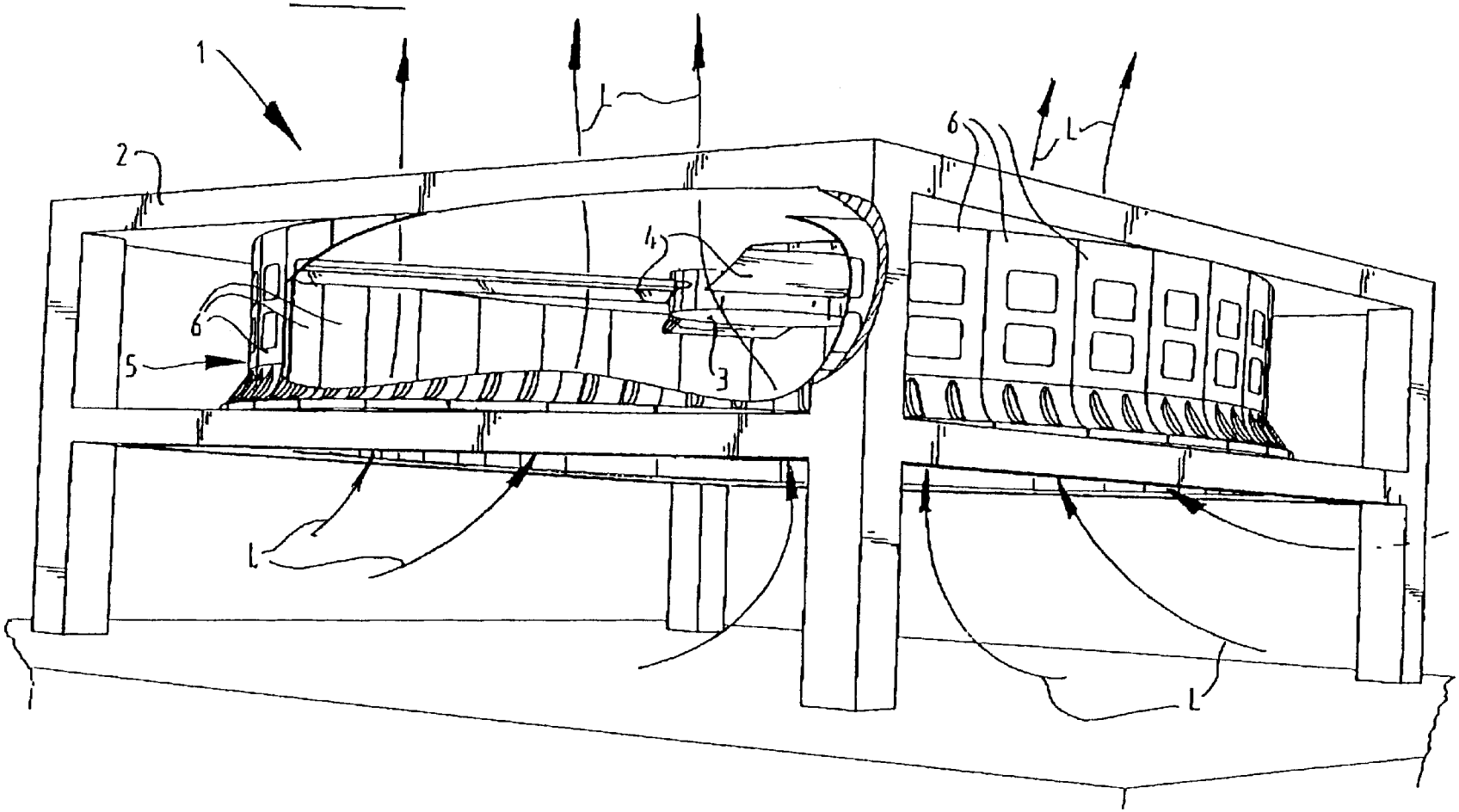
FIG. 1 shows a housing according to the invention.

FIG. 1 shows a perspective view of a part of a cooling device 1. This device 1 has a frame 2 constructed from steel beams. Suspended in this frame is a ventilating fan 3 provided with four blades 4. A housing 5 according to the invention is placed around this fan 3. This housing 5 is constructed from housing parts 6 placed against each other. When fan 3 is now driven, air L will then be drawn through housing 5 from the underside. The outgoing air can then pass through a heat exchanger, as a result of which for instance a cooling liquid or a gas is cooled.

Figure 2:
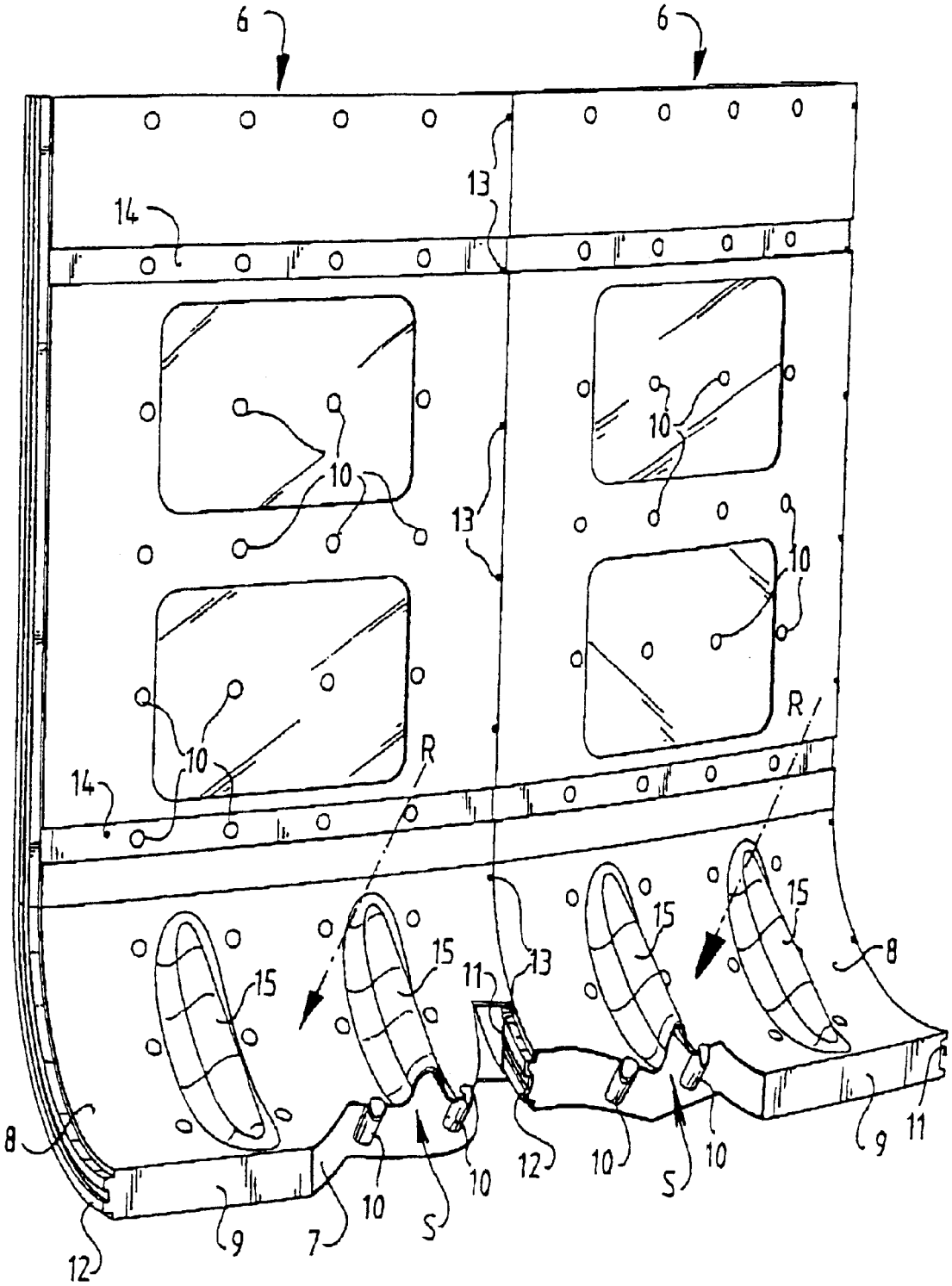
FIG. 2 shows a perspective view of two housing parts according to the invention.

FIG. 2 shows two housing parts 6 placed against each other. Each housing part 6 has an inner wall 7, an outer wall 8 placed at a distance therefrom and connecting walls 9 extending between inner wall 7 and outer wall 8.

Although not visible in the figures, inner wall 7 and outer wall 8 are curved around a first axis of curvature which coincides with the rotation shaft of fan 3. Inner wall 7 and outer wall 8 further have a second curvature R which is perpendicular to the first curvature (not shown).

Strengthening bushes 10 extend between inner wall 7 and outer wall 8. These strengthening bushes 10 result in an extra sturdiness in housing part 6, whereby bending of inner wall 7 and outer wall 8 is minimized.

Each housing part 6 has a groove 11 on a first side and a rib 12 on a second side. Grooves 11 couple with the ribs of adjoining housing parts. Two adjoining housing parts 6 are then fixed to each other by bolts 13 which extend through both the groove and the rib of an adjoining housing part.

Housing parts 6 are further provided with horizontal recesses 14 in which can run a tensioning belt not shown) with which a fully formed housing 5 can be held together.

In order to give housing part 6 additional strength at the position of the curvature R, two reinforcing ribs 15 are formed in outer wall 8.

According to the invention the closed space S defined by inner wall 7, outer wall 8 and connecting wall 9 can be filled with a foam,

I claim:

1. A housing part for a ventilating fan with an axial rotation shaft, wherein a number of housing parts can be placed radially round the ventilating fan so as to form a substantially cylindrical housing, which housing part comprises:

an inner wall;

an outer wall placed at a distance from the inner wall; and connecting walls extending between the inner wall and the outer wall, wherein the inner wall, the outer wall and the connecting walls define a closed space, wherein the housing parts are manufactured by rotation moulding.

2. The housing part as claimed in claim 1, further comprising metal parts arranged in at least one of the walls.

3. The housing part as claimed in claim 1, wherein the closed space is filled with a foamed material.

4. The housing part as claimed in claim 1, wherein the walls contain polyethylene or polypropylene.

5. The housing part as claimed in claim 1, wherein the width of the housing part is less than 2 m.

6. A housing for a ventilating fan with an axial rotation shaft, which housing comprises:

a first number of housing parts as claimed in claim 1 placed against each other radially around the ventilating fan; and fixing means for holding the housing parts fixed against each other.

7. The housing as claimed in claim 6, wherein the fixing means comprise a tensioning belt extending around the housing.

8. A housing for a ventilating fan with an axial rotation shaft, which housing comprises:

a number of housing parts as claimed in claim 1; and fixing means for holding the housing parts fixed against each other;

wherein a first portion of housing parts are placed against each other radially around the ventilating fan, and a second portion of housing parts are placed against each other and in the line of the first portion of housing parts.

9. The housing part as claimed in claim 1, further comprising at least one strengthening bush which is arranged with one end on the inner wall and with another end on the outer wall.

10. The housing part as claimed in claim 9, wherein the at least one strengthening bush is arranged such that in the formed housing the strengthening bush lies substantially in the same plane as outer ends of the ventilating fan.

11. The housing part as claimed in claim 1 further including coupling means arranged on either side for coupling to an adjoining housing part.

12. The housing part as claimed in claim 4, wherein the coupling means comprise a groove arranged on a first side of the housing part and a rib which is arranged on a second side of the housing part and which can be coupled to the groove of an adjoining housing part.

13. The housing part as claimed in claim 1, wherein the inner wall and the outer wall comprise a first curvature around a first axis of curvature.

14. The housing part as claimed in claim 13, wherein the inner wall and the outer wall comprise a second curvature around a second axis of curvature, and wherein the second axis of curvature lies perpendicularly of the first axis of curvature.

* * * * *

UNITED STATES PATENT AND TRADEMARK OFFICE

CERTIFICATE OF CORRECTION

PATENT NO. : 6,499,947 B2
DATED : December 31, 2002
INVENTOR(S) : Henricus J.B. Olthof It is certified that error appears in the above-identified patent and that said Letters Patent is hereby corrected as shown below:

Column 1,
Line 23, end of paragraph, delete comma and insert period -- . --.

Column 2,
Line 8, "pref erred" should read -- preferred --.

Column 3,
Line 50, "belt not shown)" should read -- belt (not shown) --.
Line 58, after "with a foam" delete comma and insert period -- . --.

Column 4,
Line 50, "claimed in claim 4" should read -- claimed in claim 11 --.

Signed and Sealed this

Sixteenth Day of September, 2003

JAMES E. ROGAN
*Director of the United States Patent and Trademark Office*